United States Patent [19]

Maguire

[11] 4,454,569

[45] Jun. 12, 1984

[54] LIGHTING FIXTURE PRIMARILY ADAPTED FOR USE IN ASSOCIATION WITH MODULAR OFFICE FURNITURE

[76] Inventor: Paul R. Maguire, 4284 Sea View La., Los Angeles, Calif. 90065

[21] Appl. No.: 432,581

[22] Filed: Oct. 4, 1982

Related U.S. Application Data

[63] Continuation-in-part of Ser. No. 270,929, Jun. 5, 1981, abandoned.

[51] Int. Cl.[3] ..... A47B 23/06

[52] U.S. Cl. ..... 362/127; 362/33; 362/145; 362/216; 362/220; 362/234; 362/249; 362/269; 362/275; 362/287; 362/288; 362/371; 362/391

[58] Field of Search ..... 362/33, 127, 145, 216, 362/220, 225, 234, 249, 260, 269, 285, 287, 371, 372, 398, 391, 270, 275, 288, 421

[56] References Cited

U.S. PATENT DOCUMENTS

| | | | |
|---|---|---|---|
| 2,276,559 | 3/1942 | Basnore | 362/391 |
| 2,362,100 | 11/1944 | Schwartz | 362/421 |
| 2,555,000 | 5/1951 | Nitardy | 362/220 |
| 3,917,940 | 11/1975 | Duddy | 362/398 |
| 4,118,760 | 10/1978 | Cohon | 362/239 |
| 4,254,449 | 3/1981 | Benasutti | 362/216 |

*Primary Examiner*—Donald P. Walsh

*Attorney, Agent, or Firm*—Jackson, Jones & Price

[57] ABSTRACT

Disclosed is a lighting fixture which is primarily adapted for removable attachment to modular office furniture and for adjustable, substantially glare-free illumination of a work surface. The lighting fixture has a substantially elongated housing for a ballast, and a pair of holders for fluorescent tubes which are pivotably attached to a lower surface of the housing. A fastening device is attached to the housing which enables removable attachment of the lighting fixture to the underside of a shelf or the like, preferably without physically altering or changing the shelf. A channel shaped member having an upwardly open face is attached to and is disposed substantially along the entire length of the housing in order to unobtrusively accommodate at least a portion of a cable which connects the lighting fixture with an electric outlet. A user may adjust the positioning of each tube holder relative to the housing in order to obtain an optimal lighting effect on the work surface.

35 Claims, 17 Drawing Figures

FIG. 1
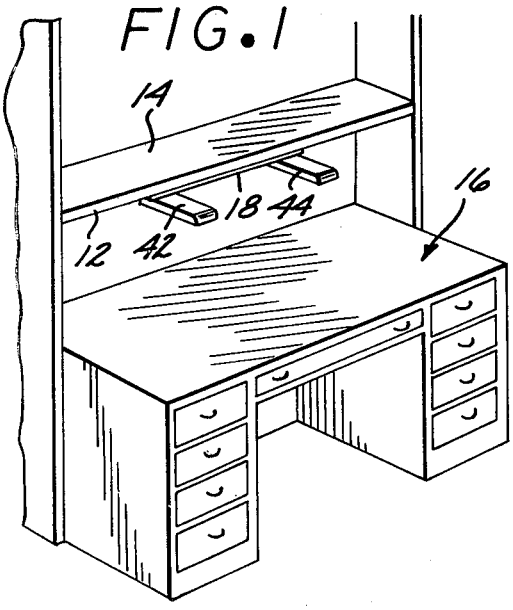
FIG. 2
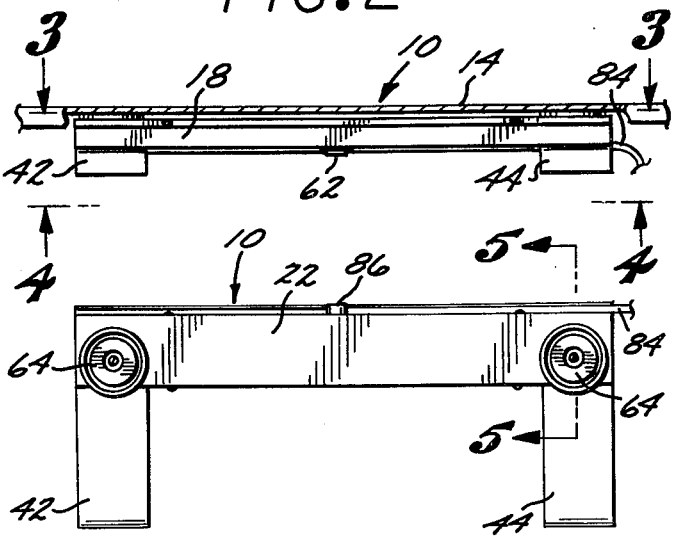
FIG. 3
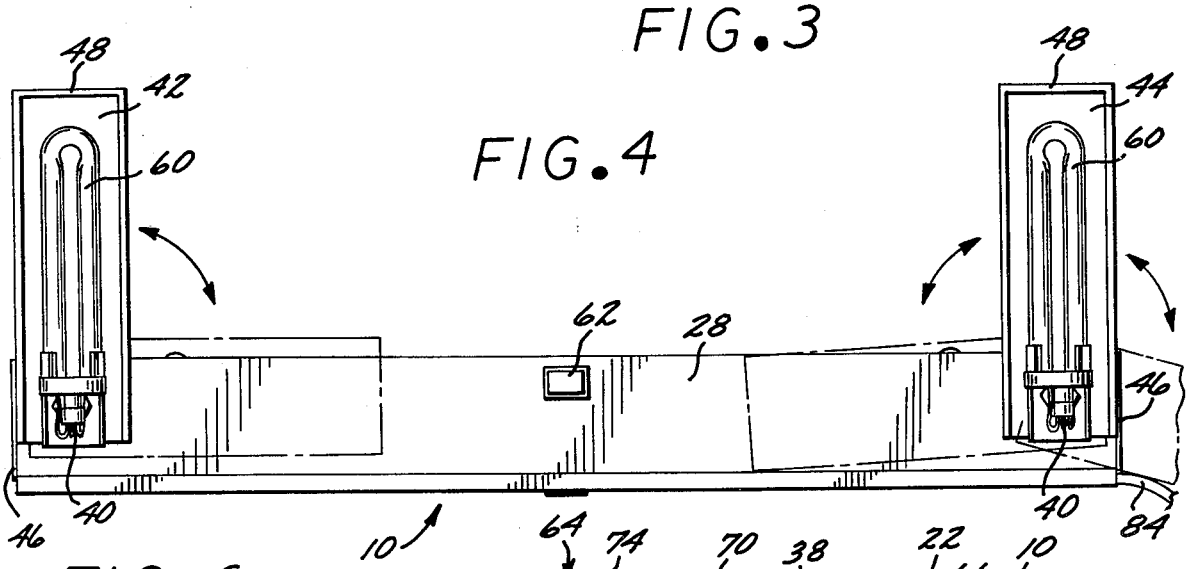
FIG. 4
FIG. 6
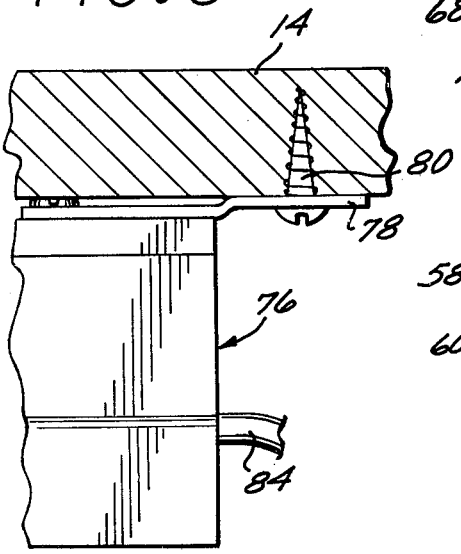
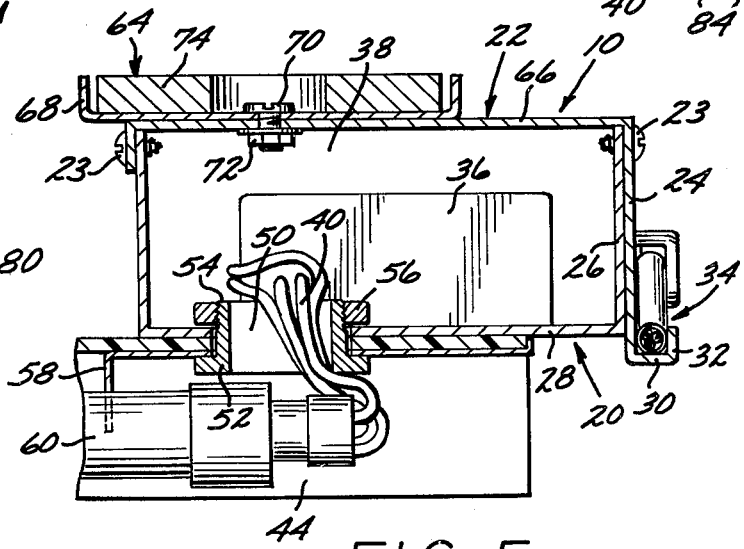
FIG. 5

LIGHTING FIXTURE PRIMARILY ADAPTED FOR USE IN ASSOCIATION WITH MODULAR OFFICE FURNITURE

RELATED APPLICATIONS

This application is a continuation-in-part of U.S. patent application Ser. No. 270,929 filed June 5, 1981, now abandoned, entitled "Lighting Fixture Primarily Adapted for Use in Association with Modular Office Furniture," and incorporated herein by reference.

BACKGROUND OF THE INVENTION

1. Field of the Invention

The present invention relates to a lighting fixture, and more particularly to a lighting fixture specifically adapted for use in association with modular office furniture.

2. Brief Description of the Prior Art

A great variety of lighting fixtures have been provided in the prior art. More particularly, in the field of non-permanently attached lighting fixtures, principal attention was focused in the prior art on the mode of attachment of the fixture to a desk, workbench, or the like, and on the capability of the lighting fixture to be subjectively adjusted by a user for optimal illumination of the desk or workbench.

For example, U.S. Pat. No. 3,917,940 issued to Dudy describes a desk lamp which has a flat, broad magnetic base. The base is usable in a conventional manner to support the lamp on a horizontal surface, such as a desk top. The base, due to its magnetic nature, may also be used to attach the lamp to a vertically disposed ferromagnetic surface, or to suspend the lamp in a hanging position form a horizontally disposed ferromagnetic surface.

U.S. Pat. No. 2,555,000 issued to Nitardy describes a lighting fixture or lamp, having a base which is mechanically clampable to an edge of a desk top, workbench top or the like. The lighting fixture includes a two-part substantially horizontally disposed lamp housing attached to the posts. Each post of the lamp housing incorporates a fluorescent light tube and is pivotable in a horizontal plane. As a result, a desired angular positioning of the two fluorescent light tubes relative to one another and the desk top may be adjusted by a user.

Additional disclosures relating to adjustable or removable lighting fixtures may be found in U.S. Pat. Nos. 2,809,281; 2,131,708; 1,934,902; 4,161,767; 1,757,346; 4,197,573; 2,089,419; 4,136,377 and 2,998,508.

Recently, the increasing need for efficient and economic utilization of office space has resulted in increasing the acceptance and use of removable and rearrangeable modular partition walls, modular furniture and shelving. Such modular partition walls and related modular office equipment are described in U.S. Pat. Nos. 4,185,430; 4,176,889; 4,070,803; 4,056,297; and 4,102,095. As appreciated by those skilled in the art, the aforementioned use of modular partition walls and modular office furniture and the rapidly increasing cost of electrical energy enhanced the need for lighting fixtures which are easily movable, attachable to modular office furniture and individually adjustable to efficiently illuminate a desired area. The lighting fixture of the present invention is designed to satisfy this need.

SUMMARY OF THE INVENTION

The lighting fixture of the present invention provides the following advantages:

(1) it is removably attachable to the underside of a shelf or the like to illuminate an area disposed below the shelf and more particularly to accommodate the demands of the modular office furniture industry;

(2) it has individual fluorescent light tubes, wherein angular positioning of each light tube can be adjusted over a wide angular range to provide substantially glare-free illumination of a work surface, such as a desk top, in accordance with the subjectively determined need of a user, and in one embodiment of this invention the tubes may be moved in both horizontal and vertical directions;

(3) any cord or cable leading to the lighting fixture can be positioned in an unobstrusive manner so as to minimize interference with the surrounding work environment, and connected in a fashion that prevents the cord from being wound up upon itself;

(4) it is removably attached to the underside of a shelf by fastening means that do not physically alter or change the shelf;

(5) it includes means for insulating the electrically active components so that, if a short circuit occurs, current will not flow into the modular office furniture;

(6) it provides an enclosure for the fluorescent tubes which, if a tube breaks, retain substantially all the glass pieces of the broken tube within the enclosure; and (7) it optimizes the usage of light and permits the light fixture to be moved both laterally and in or away from the shelf to which it is mounted.

These and other advantages are attained by this lighting fixture which has a substantially elongated housing for a ballast and other electric components, and a pair of holders for fluorescent tubes pivotably attached to a lower surface of the housing. In the preferred embodiment, the holders pivot in both the horizontal and vertical directions. A fastening device is attached to the housing, enabling removable attachment of the lighting fixture to the underside of a shelf or the like. Preferably, this fastening device does not physically alter or change the shelf. A channel shaped member having an upwardly open face can be integrally attached to and is disposed substantially along the entire length of the outer rear housing in order to unobtrusively accommodate at least a portion of a cable which connects the lighting fixture with a standard electric outlet. Due to the pivotable nature of the holders for the fluorescent tubes, a user may position the tubes in subjectively determined positions to obtain optimal lighting effect on a working surface such as a desk top below the shelf.

The features of the present invention, together with the above and further advantages, can best be understood from the following description taken together with the accompanying drawing, in which like numerals indicate like parts.

BRIEF DESCRIPTION OF THE DRAWINGS

FIG. 1 is a perspective view of a desk and a shelf disposed above the desk, the lighting fixture of the present invention being attached to the shelf, the view showing a typical application of the lighting fixture of the present invention;

FIG. 2 is a front view of a first preferred embodiment of the lighting fixture of the present invention, a shelf to which the lighting fixture is attached being shown in cross-section;

FIG. 3 is a top view of the first preferred embodiment of the lighting fixture of the present invention;

FIG. 4 is a bottom view of the first preferred embodiment of the lighting fixture of the present invention, several alternative positions of fluorescent tube holding members of the fixture being shown with dotted lines;

FIG. 5 is partial cross-sectional view of the first preferred embodiment of the lighting fixture of the present invention, the cross-section being taken on lines 5—5 of FIG. 3;

FIG. 6 is a partial front view of a second preferred embodiment of the lighting fixture of the present invention, a shelf to which the lighting fixture is mounted being shown in cross-section;

DESCRIPTION OF THE PREFERRED EMBODIMENT

Figure 7A:
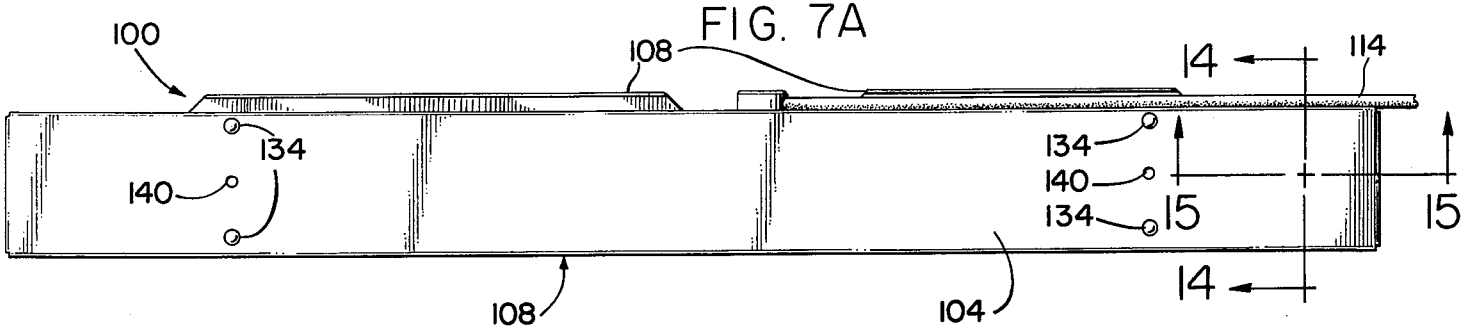
FIG. 7A is a plan view of a third embodiment of this invention wherein the fluorescent tube holders are mounted to pivot in both vertical and horizontal directions.

The following specification taken in connection with the drawings sets forth the preferred embodiments of the present invention in such a manner that any person skilled in the lighting fixture manufacturing arts can use the invention. The embodiments of the invention disclosed herein are the best modes contemplated by the inventor for carrying out his invention in a commercial environment, although it should be understood that various modifications can be accomplished within the parameters of the present invention.

Referring now to the drawing Figures, and particularly to FIGS. 2, 3, 4 and 5, a first preferred embodiment 10 of the lighting fixture of the present invention is disclosed. The lighting fixture of the present invention is specifically designed and adapted for use in association with modular office furniture, although it may also be used in association with more conventional furniture. More particularly, the lighting fixture of the present invention is specifically adapted for rapid and removable fastening to the underside 12 of a modular shelf or the like, as is shown in FIG. 1. Still more particularly, the first preferred embodiment 10 of the lighting fixture of the present invention is adapted for magnetic fastening to a shelf 14 or the like comprising ferromagnetic material. This is because magnetic fastening permits the desired ready removability and ease of positioning of the lighting fixture 10 relative to the shelf 14 and to a work surface, such as the desk 16, shown in FIG. 1.

The lighting fixture 10 includes an elongated housing 18, which has a substantially square shaped cross-section, as is shown on FIG. 5. The housing 18 has a lower section or part 20 and an upper section or part 22. Both sections or parts 20 and 22 of the housing 18 are conveniently manufactured from stamped sheet metal, although other materials, such as molded plastic, may also be suitable for their construction.

The lower part 20 of the housing is channel shaped, and has an upwardly disposed open face. The upper part 22 of the housing 18 is complementary to the lower part 20, and acts as a cover or lid for the lower part 20. In the hereindescribed preferred embodiment the upper part 22 is attached to the lower part 20 by screws 24, shown on FIG. 5.

The upper part 22 of the housing 18 also includes a back plate or flange 24 which is disposed adjacent to and outside of a back plate 26 of the lower part 20. This is best shown on FIG. 5. The back plate 24 of the upper part 22 protrudes below a base plate 28 of the lower part 20, and has a first lip or flange 30 attached substantially at a right angle thereto. A second lip or flange 32 is attached substantially at a right angle to the first lip 30. The back plate 24, the first lip 30 and second lip 32 together form an open faced channel 34 which is disposed substantially along the entire length of the housing 18, and slightly below the lower part 20 of the housing 18. The purpose of the channel 34 is described below.

A ballast 36 is mounted within the interior 38 of the housing 18. The ballast 36 is generally known to be necessary for the operation of fluorescent lights. Other electric components, such as insulated wires 40 are also incorporated in the housing 18. A detailed description of the electrical parts is not considered necessary here for the purpose of describing the present invention, because such parts are generally used and known in the industry.

Referring still principally to FIGS. 1–5, a first fluorescent tube holder 42 and a second fluorescent tube holder 44 are shown mounted to the base plate 28 of the lower part 20 of the housing 18. The tube holders 42 and 44 are substantially adjacent to respective ends 46 of the elongated housing 18. As is best shown on FIG. 4, each fluorescent tube holder 42 and 44 is a substantially channel shaped member having a downwardly directed open face. Each tube holder 42 and 44 also have a closure plate 48 which closes the channel at an end of the respective tube holders 42 and 44 which is remote from the mounting of the tube holders 42 and 44 to the housing 18.

Each tube holder 42 and 44 is rotatably mounted to the base plate 28 of the lower part 20 of the housing 18. More specifically, both the base plate 28 and the respective tube holders 42 and 44 have a substantially circular aperture 50, and a cylindrical, hollow flanged fitting 52 is fitted in the aperture 50. An end 54 of the fitting 52 can be threaded to receive a matching threaded nut 56 which is disposed in the interior 38 of the housing 18. Alternatively, a conventional frictional fastener assembly could be used. A metal clip 58 is held between the flanged fitting 52 and the fluorescent tube holders 42 and 44. The clip 58 holds a U-shaped fluorescent tube 60 which is disposed substantially within the interior of the channel shaped holder 42 or 44. The wires 40 interconnect the fluorescent tubes 60 with the ballast 36.

A switch 62 is mounted to the base plate 28 of the lower part 20 of the housing 18 substantially in the center of the elongated housing 18. The switch 62 is shown on FIGS. 2 and 4.

In the herein described preferred embodiment, the lengths of the fluorescent tube holders 42 and 44 is designed in such a manner that both holders 42 and 44 clear the switch 62 as they are rotated relative to the housing 18. As a result, both holders 42 and 44 may be disposed below the housing 18 in parallel alignment therewith. This is an ideal position of the fluorescent tube holders 42 and 44 for packaging and shipping the lighting fixture 10, and may also be desired as an operative lighting configuration. In the herein described embodiment, the fluorescent tube holders 42 and 44 are molded from white colored plastic so as to maximize downward reflection of light emanating from the fluorescent tubes 60.

Referring now principally to FIGS. 3 and 5, a pair of magnetic fasteners 64 each include a substantially saucer shaped metal plate 68 which is attached by a bolt 70 and a nut 72 to the housing 18. A substantially disc shaped, strong, permanent magnet 74, best shown on FIG. 5, is included in each metal plate 68. The permanent magnets 74 are designed to require approximately 70 pounds of downwardly projecting force to separate the respective magnet 74 from a ferromagnetic surface, such as the shelf 14, to which the magnet 74 is attached.

Referring now to FIG. 6, a second preferred embodiment 76 of the lighting fixture of the present invention is shown. The second preferred embodiment 76 is identical in most respects to the first preferred embodiment 10. However, in contrast to the first preferred embodiment 10, the second preferred embodiment lacks the magnetic fasteners 64. Instead, it includes a pair of mounting plates 78. Only one of the mounting plates 78 is shown on FIG. 6. The mounting plates 78 are bolted to the upper part 22 of the housing 18, and are attached to a wooden shelf or the like by wood screws 80, as is shown on FIG. 6. Alternatively, the mounting plates 78 may also be attached to a metal shelf by machine screws and nuts (not shown) or by sheet metal screws (not shown).

The first embodiment 10 of lighting fixture of the present invention is attached to the underside of a ferromagnetic metal shelf 14 through the magnetic fasteners 64. The positioning of the fixture 10 relative to the shelf 14 is subjectively determined by a user (not shown) so as to provide optimal illumination onto a work surface 82 which is disposed substantially below the shelf 14. The angular positioning of each fluorescent light tube holder 42 and 44 is further adjusted by the user (not shown) to provide optimal, substantially glare-free lighting on the work surface 82. The positioning of the tube holders 42 and 44 may be adjusted from time to time as the nature of work performed at the desk 16, or as different requirements of different individual users may render it desirable. The channel 34, however, prevents 360° rotation of the tube holders 42 and 44 relative to the housing 18 so that inadvertent winding-up and overstressing of the wires 40 by excessive rotation of the tube holders 42 and 44 is avoided.

A cable 84 is lead into the interior 38 of the housing 18 through a standard strain relief bushing 86 mounting in the back plates 24 and 26 of the upper and lower housing parts 20 and 22, respectively. The cable 84 leads to a standard electric outlet (not shown). As is shown on FIG. 3, the cable 84 is unobtrusively accommodated in the channel 34 in order to prevent it from dangling behind the lighting fixture and interfering with utilization of working space above the work surface 82.

As shown in FIGS. 7A through 15, the third embodiment 100 of the lighting fixture of this invention is similar to the other two embodiments in that it includes a housing 102 having an upper and lower section 104 and 106 with a channel member 108 extending along substantially the entire length of the housing, a pair of tube holders 110 and 112 at opposite ends of the housing and mounted to the lower surface of the housing, and a cord 114 connecting U-shaped fluorescent tubes 116 in the tube holders to an electrical outlet. The cord 114 includes a wire connecting the tube to ground.

This embodiment, in addition to the features of the other embodiments, has several additional advantages. First, the tube holders 110 and 112 are mounted to pivot in both the horizontal and vertical directions. Secondly, each of these tube holders are designed to provide an enclosure 118 (FIG. 11) which, if the tube breaks, retains substantially all the broken pieces within the enclosure. Thirdly, the lighting fixture is suspended by wire elements 120 (FIGS. 9 and 12) which provide a more secure way of supporting the lighting fixture from the underside of a shelf 19 than using a magnet. Fourthly, the upper section of the housing is electrically insulated from the lower section of the housing so that, if there is a short circuit, current will not flow through the upper section into the modular furniture to which the lighting fixture is attached.

Figure 7B:
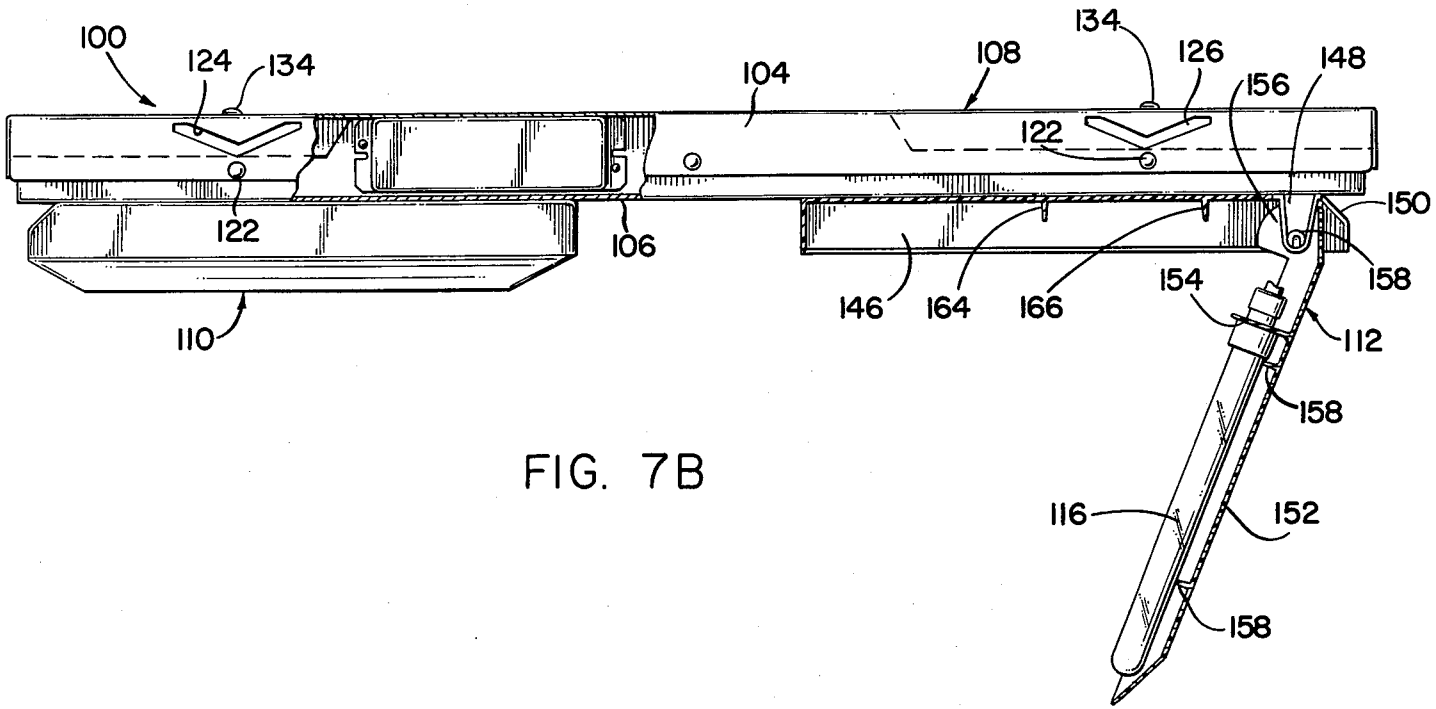
FIG. 7B is a side elevational view with sections broken away of the third embodiment of this invention showing one of the tube holders open for replacement of a fluorescent tube.

Referring to FIGS. 7A and 7B, the upper and lower sections 102 and 104 are both made of metal. These sections are secured together by means of screws 122 which are received in self-threading plastic nuts 124 which are retained in holes in the upper and lower sections. The nuts 124 have integral there with a spacer **124*a*** which serves to insulate the upper section from the lower section. Thus, if a short circuit occurs, current will not flow into the upper section and into the furniture to which the fixture is attached.

Each side of the upper section includes a pair of V-shaped slots, with the pairs of slots on opposed sides aligned to form a pair of channels 124 and 126 passing through the housing. The wire elements 120 are inserted into the channels 126. One of these wire elements 120 is shown in detail in FIG. 10. Both wire elements are identical. Each includes two pairs of fingers 128 and 130 in opposed ends of the element. Each pair of fingers is aligned with respect to each other to form a V configuration. The pair of fingers 128 are joined together at their ends, but the pair of fingers 130 are not joined together at their ends. The fingers 128 are connected to the fingers 130 by arms 132. These wire elements are designed to be inserted into the channels 126 in the housing.

Figure 9:
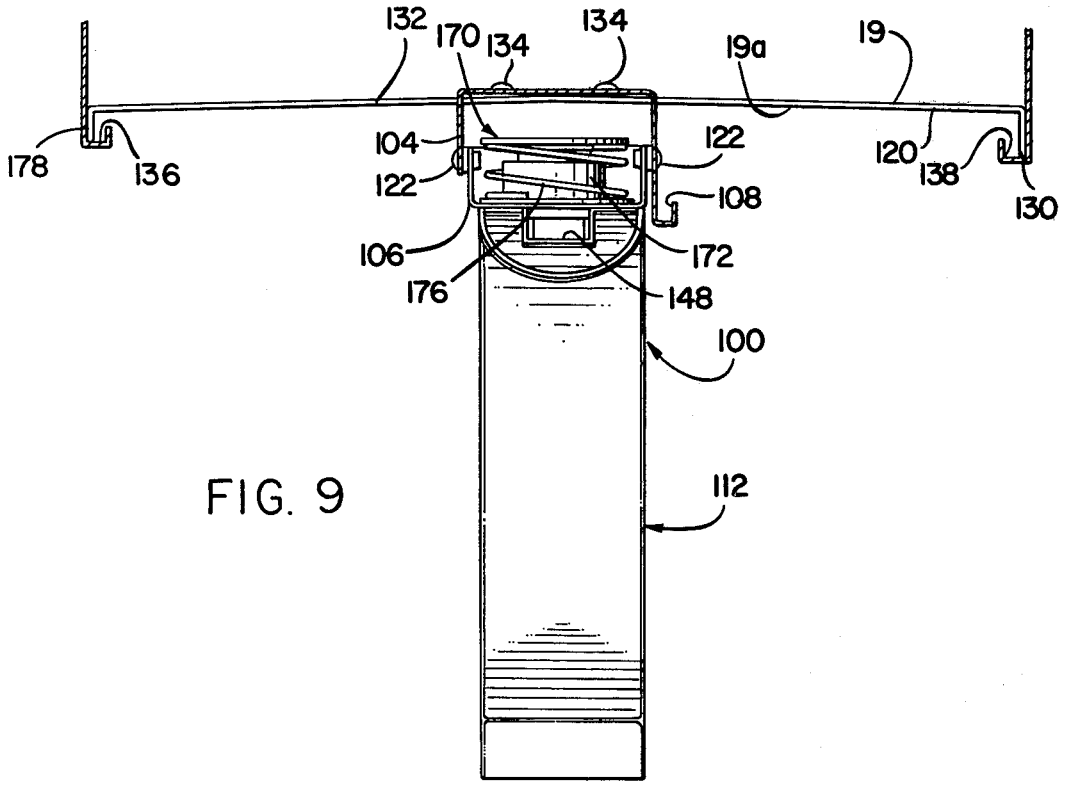
FIG. 9 is a cross-sectional view taken along line 9—9 of FIG. 8, with the self to which the lighting fixture attached shown in cross-section.
Figure 12:
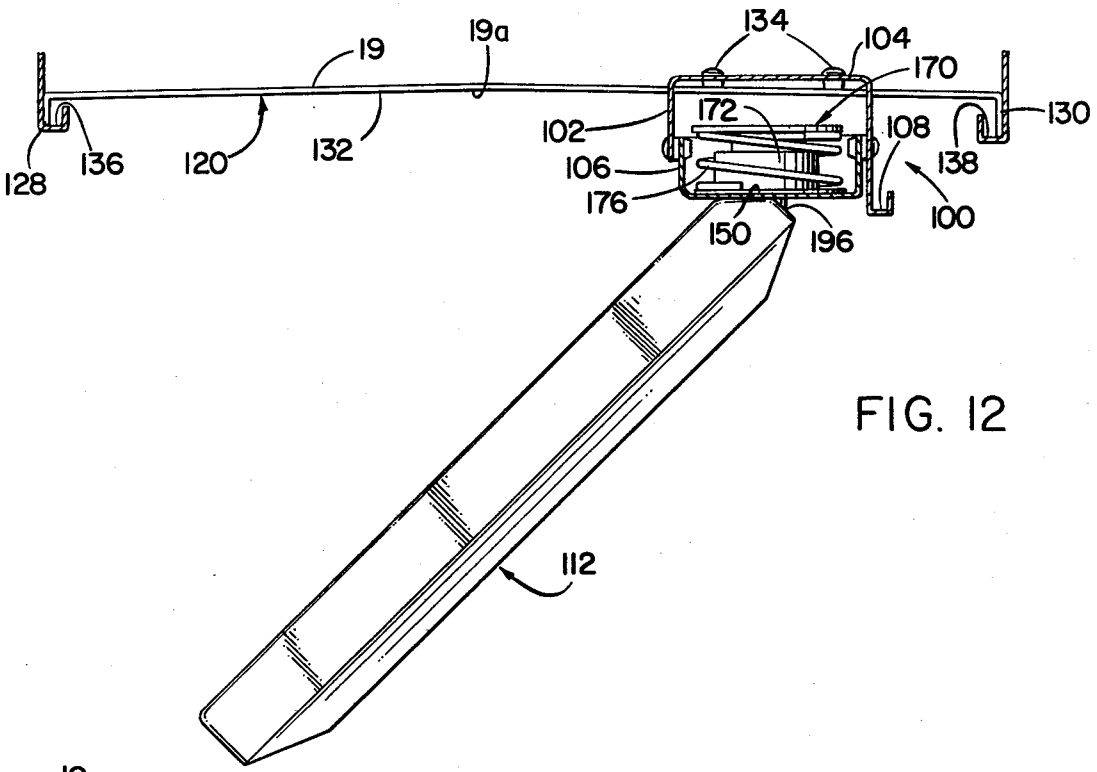
FIG. 12 is a side elevational view similar to that shown in FIG. 9, but with the fixture moved to a different position relative to the underside of the shelf and the tube holder rotated approximately through a 90° angle.

As best shown in FIGS. 9 and 12, the lighting fixture 100 is adapted to be mounted to the underside of a shelf 19 by means of the wire elements 120. The shelf has along its underside a track comprising two spaced-apart rails 136 and 138 which have a J-shaped cross-section. The rails are disposed so that the bend of the J's point inwardly, facing each other. The lighting fixture 100 is mounted to this shelf 19 by first inserting the wire elements 120 in the channels 126 in the housing and then inserting the fingers 128 into the one J rail 136 while at the time spreading the arms 132 to separate the fingers 130 and then inserting these fingers into the other J rail 138 while spread apart. Upon release of the arms 132, the fingers 130 return to the position shown in FIG. 10. This creates a slight bow in the wire elements 120, biasing wire elements in an upward direction so that the lighting fixture 100 is held snug against the underside 19*a* of the shelf 19.

As shown best in FIG. 7A, two pairs of nylon buttons 134 in the top surface of the upper section 104 prevent the entire upper surface of the upper section from engaging the underside of the shelf. These buttons 134 provide a low friction contact point which enables the lighting fixture to be moved laterally along the length of the shelf, for example, from the position shown in solid lines in FIG. 13 to the position shown in dotted lines in this FIG. 13. One may move the lighting fixture 100 by simply pushing sideways against the housing. This causes the fingers to slide along the J rails 136 and 138, with the nylon buttons sliding along the underside 19*a* of the shelf.

As an optional feature, the upper section has a pair of holes 140 (FIG. 7A) which enable the upper section to be secured, for example, by means of screws to the underside of a shelf. Although this type of mounting is not preferred, in some instances it will be the only way the lighting fixture can be mounted to the underside of the shelf. This type of mounting is similar to that shown in FIG. 6.

Figure 11:
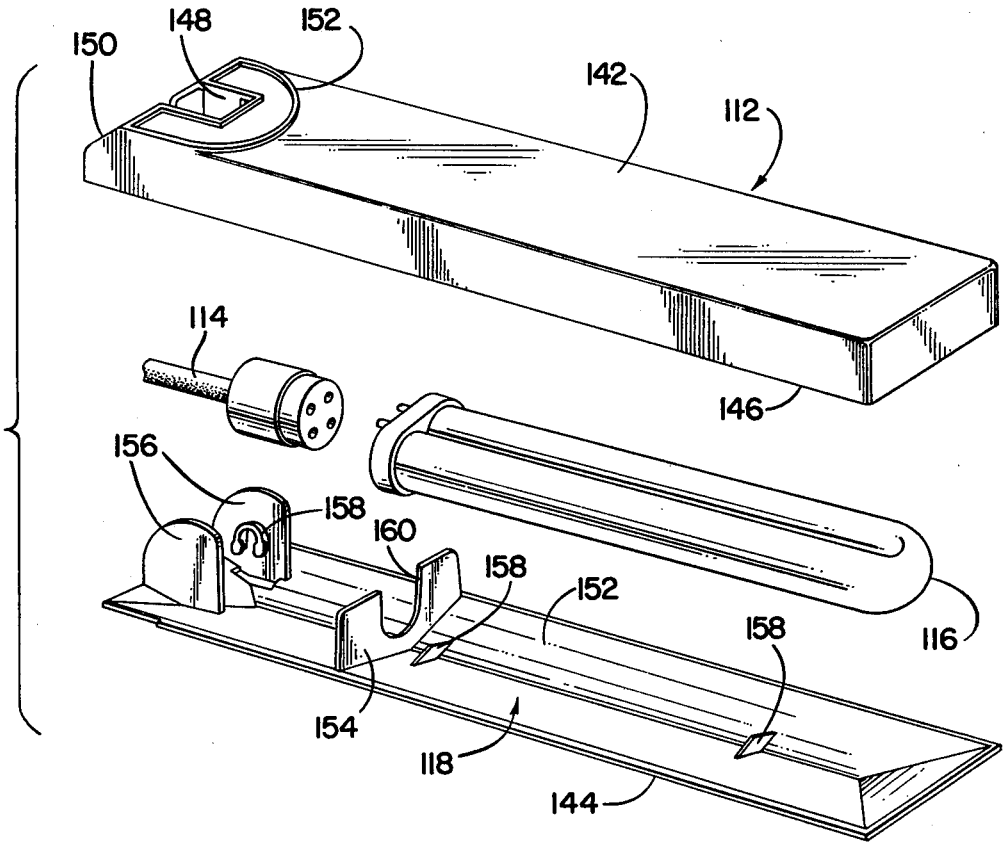
FIG. 11 is an exploded perspective view of one of the tube holders.
Figure 15:
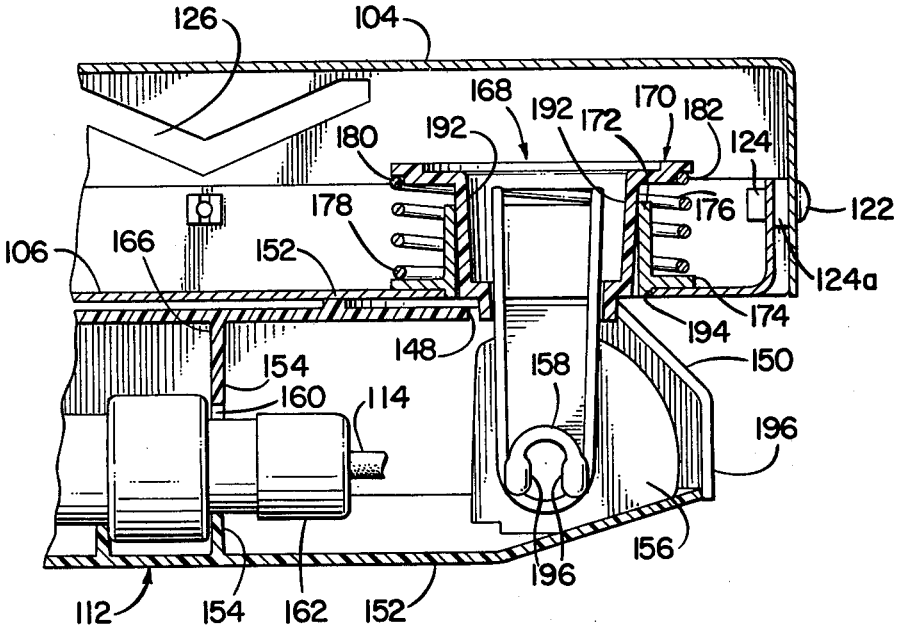
FIG. 15 is a cross-sectional view taken along line 15—15 of FIG. 7A.

As best shown in FIGS. 7B and 11, the tube holder includes a translucent shade and a transparent lens 144. The shade, preferably made of a pigmented polycarbonate, is essentially a box-like member having an open underside 146 and an opening 148 extending through its top. The one end of the shade is truncated to provide a flat plate 150. As will be explained in detail below, this flat plate enables the tube holder to be held at an angle of approximately 45° with respect to the housing. There is a C-shaped ridge 152 which surrounds the opening. As best shown in FIG. 15, this ridge 152 serves as a spacer to prevent the top of the shade from directly engaging the underside of the lower section.

The lens 144 is made of a transparent plastic material, preferably unpigmented polycarbonate, and it includes a cover member 152 having a V-shaped cross-section, a wall 154 integral with the cover member and disposed generally perpendicular to the longitudinal axis of the cover member, a pair of space brackets 156 which are disposed on opposite sides of the longitudinal axis of the cover member, and a pair of space V-shaped guides 158. The brackets 156 have on their inside walls a pair of trunions 158 aligned with each other which, as will be explained in greater detail below, serve as an axle about which the tube holder may pivot in a vertical direction. There is a passageway 160 in the wall 154 which holds a receptacle 162 for the prongs of the fluorescent tube 116.

In accordance with one feature of this invention, the tube holder includes the enclosure 118 which, if the fluorescent tube breaks, retains substantially all the broken pieces of the tube. This enclosure 118 is formed by the shade 142, the lens 144 and the wall 154. The wall acts as a partial barrier. Of necessity, the receptacle 162 must pass through this wall and there will therefore be a slight gap through which some broken pieces of tube may escape the enclosure. This, however, is kept at a minimum and the probability of glass escaping through this gap and reaching the work surface is remote.

When the lens 144 is covering the open face 146 of the shade, the V-shaped guides 158 in the lens are inserted between the two legs of the fluorescent tube. In a similar manner, there is provided in the underside of the shade a one V-shaped member 164 which also are inserted between the legs of the tube. Another member 166 in the underside of the shade engages the pronged end of the tube. These members 164 and 166 hold the tube in position.

Figure 16:
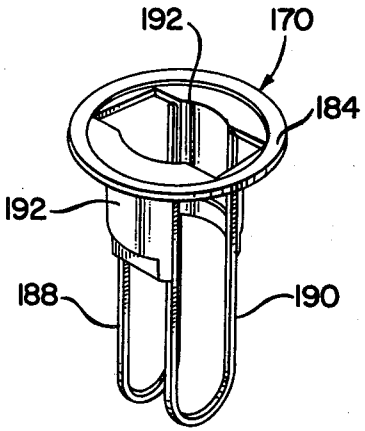
FIG. 16 is a perspective view of the stirrup of the hinge mechanism for the tube holder.
Figure 10:
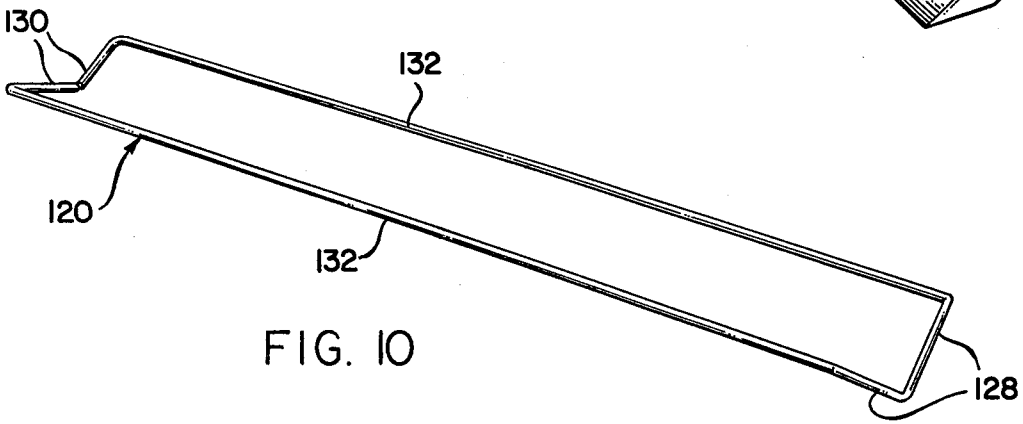
FIG. 10 is a perspective view of the wire element used to support the fixture from the underside of the shelf.
Figure 14:
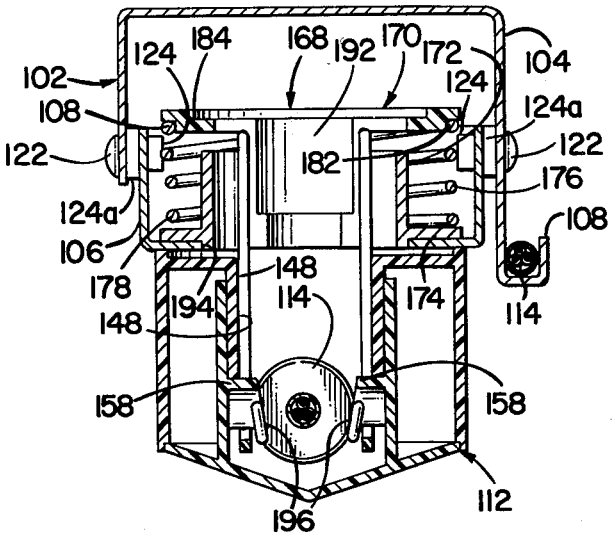
FIG. 14 is a cross-sectional view taken along line 14—14 of FIG. 7A.

As illustrated in FIGS. 14 through 16, the hinge mechanism 168 for the tube holders includes a stirrup 170, an annular member 172 having a lip 174 extending outwardly therefrom, and a coiled spring 176 which winds about the annular member. The opposed ends 178 and 180 respectively engage the lip and an indentation 182 in a flange 184 extending about the open top 186 of the stirrup. The stirrup has two looped legs 188 and 190 extending downwardly from the flange. Support elements 192, integral with the flange, keep the legs 188 and 190 separated and provide structural rigidity to the stirrup.

The hinge mechanism is assembled as follows: The annular member 172 is placed in position over a circular opening 194 in one end of the lower section of the housing. The spring 176 is placed over the annular member and then the stirrup 170 is inserted through the spring and annular member into the opening 148 in the shade. The looped legs 188 and 190 may move slightly with respect to each other and they are depressed inwardly towards each other so that they pass over the trunnions in the brackets. Once the looped legs have cleared the trunnions 158, they spring back to their normal position. As these legs are being moved into engagement with the trunnions, the spring 176 is depressed. The spring is normally urging the stirrup upwardly. The trunnions include bosses 196 which serve to retain the looped legs in position. This pulls the looped legs snug against the trunnions. The bosses overlie a portion of the looped legs, thereby preventing the looped legs from slipping off the trunnions.

Figure 13:
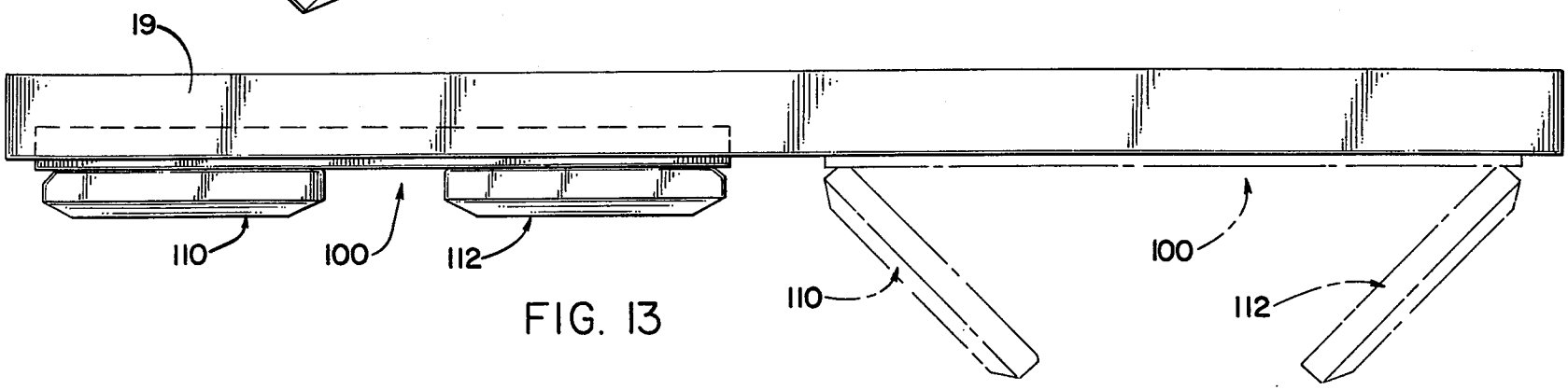
FIG. 13 is a side elevational view of a lighting fixture of the third embodiment mounted to the underside of a shelf, with an alternate position of the fixture relation to the shelf being shown in dotted lines.

The lighting fixture is designed to provide the maximum amount of versatility, enabling the user to locate the fixture 100 and the tube holders 110 and 112 relative to the work surface so that lighting of the work surface will be optimized. Because of the way the lighting fixture is mounted to the underside 19*a* of the shelf, the entire fixture may be moved either to the left or right laterally along the length of the shelf, as illustrated in FIG. 13. Also as shown in FIGS. 9 and 12, the fixture 100 can be moved along the wire support elements 120 traverse to the lateral movement along the length of the shelf. Like the tube holders of the other embodiments, the tube holders 110 and 112 may each be moved in a generally horizontal direction pivoting about the hinge mechanism 168. The channel member 108 will serve as a stop to prevent 360° rotation of these tube holders, thus avoiding any damage to the cord 114. The cord 114, extending from the tubes 116, is pasted between the looped legs 188 and 190 through the open top of the stirrup, out the housing and into the channel 108. This routing of the cord has not been shown.

Figure 8:
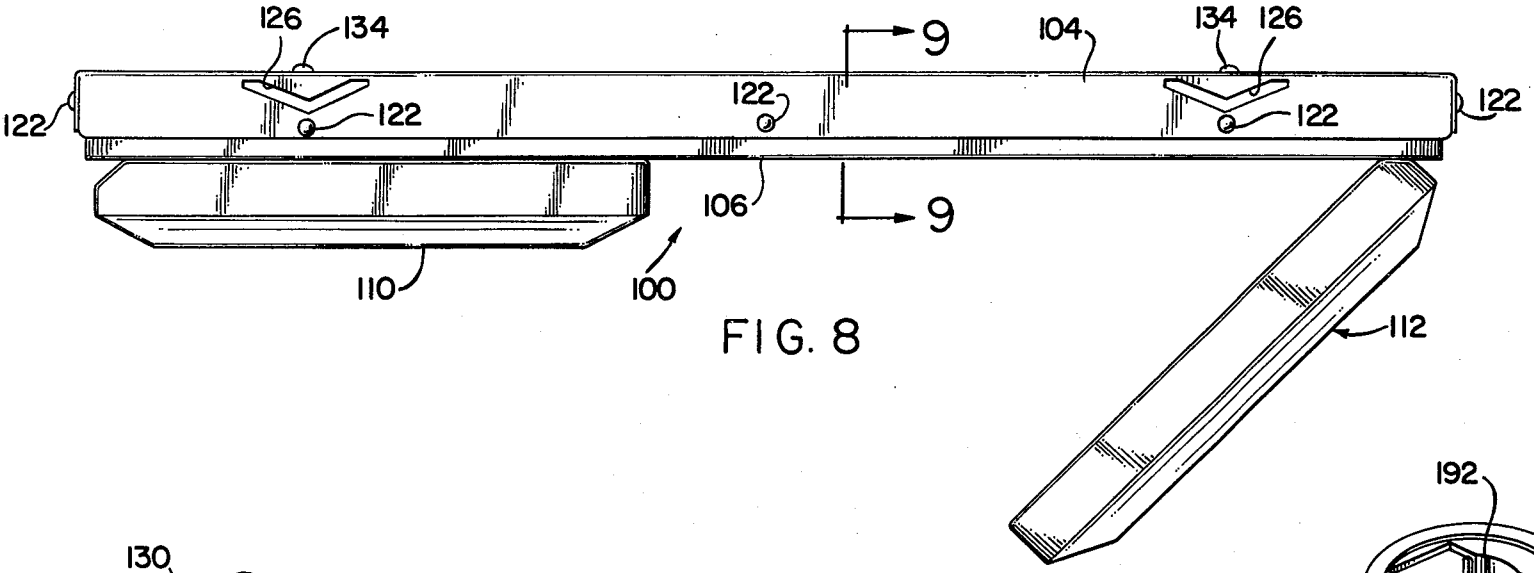
FIG. 8 is a side elevational view of the third embodiment of this invention with one tube holder moved vertically so that it is at an angle of approximately 45° with respect to the housing.

In accordance with this invention, the tube holders 110 and 112 are also adapted to pivot vertically about the hinge mechanism 168 as illustrated in FIGS. 8, 9 and 12. One simply pulls downwardly on the tube holder. This causes the trunnions to rotate within the looped legs 188 and 190 of the stirrup. In accordance with this particular design, there are two vertical positions for a tube holder. These two positions are illustrated in FIG. 12. The one shown in solid lines is approximately 45° with respect to the underside 119*a* of the shelf; the other, shown in dotted lines, is at approximately 90° with respect to the underside of the shelf. The flat plate 150 in the one end of the shade 142 provides the means for holding the tube holder in the 45° position. In this position the flat plate abuts the underside of the upper section 104 of the housing. Pushing against the tube holder toward the right as illustrated in FIG. 12 will cause the trunnions 158 to further rotate within the stirrup to bring the edge 196 of the shade into contact with the underside of the upper section 104 of the housing. The end of the lens serves as a stop which prevents further rotation of the tube holder. As illustrated in FIG. 7B, the lens may be pivoted independently of the shade. This enables one to change a burned-out tube.

What has been described above is a novel lighting fixture. The novel lighting fixture is ideally adapted for use in association with modular office furniture and is designed to provide continously adjustable lighting positions for optimal illumination of a work surface. Moreover, the tube holders and hinge mechanism, with the exception of the spring, are all made of molded plastic parts. Because of the way these parts have been designed, in particular the hinge mechanism, they can be made at low cost. The main reason is not that they are plastic but because under cuts and other expensive molding techniques are avoided. Several modifications of the above-described lighting fixture may become readily apparent to those skilled in the art in light of the above disclosure. Therefore, the scope of the present invention should be interpreted solely from the following claims.

I claim:

1. A lighting fixture primarily adapted for use in association with modular office furniture having a horizontal surface and a pair of support tracks without the use of permanent fasteners, the fixture comprising:

an elongated housing adapted for incorporating a ballast and including a lower section and an upper section attached to each other;

first and second fluorescent tube holding members pivotably attached to a lower surface of the lower section of the housing for both vertical and horizontal movement;

removable fastening means attached to the upper surface of the upper section housing for movably mounting the housing underneath a substantially horizontal surface including a pair of spaced wire support elements which pass through slots in the housing in a relatively movable manner and are adapted to having their ends engage tracks along the horizontal surface, the ends further capable of free movement along the support tracks, and cable means for operatively connecting fluorescent tubes in the holding members to electrical power from a standard electric outlet.

2. The lighting fixture of claim 1 wherein the lower and upper sections are both made of metal, with insulating means separating said sections and with the lower section connected to ground so that, if a short circuit occurs, current will not flow through the upper section into the modular office furniture.

3. The fixture of claim 1 further including catch means mounted to the housing for preventing full 360° rotation of each fluorescent tube holding member relative to the housing.

4. The fixture of claim 1 wherein the lighting means each include an enclosure for a fluorescent tube which, if the tube breaks while in the enclosure, retains substantially all the pieces of the broken tube, said enclosure comprising a translucent shade member having an open face and lens means covering the open face, said shade member and lens means being movable relative to each other to enable one to replace a broken or burned out fluorescent tube.

5. The fixture of claim 1 wherein the upper section of the housing includes a downwardly protruding flange disposed substantially parallel with a back plate of the lower section of the housing, the flange extending below the lower surface of the lower section, the upper section of the housing further including a substantially horizontally disposed first lip attached to the flange and a substantially vertically disposed second lip attached to the first lip, the flange and first and second lips forming a channel extending below the lower surface of the lower section of the housing; and wherein the cable means include a cable connecting the lighting fixture with the electric outlet, the channel being adapted to accommodate a portion of the cable, and acting as catch means for preventing full 360° rotation of the first and second fluorescent tube holders.

6. The fixture of claim 1 including mounting means for the tube holding members comprising spring biased stirrup means adapted to pivotably mount an end of the associated tube holding member through trunnion means at the end of the tube holding member, said trunnion means being removably received in the stirrup means.

7. A lighting fixture primarily adapted for use in association with modular furniture and adapted to be removably suspended from the underside of a substantially horizontally disposed surface such as a shelf and the like having support tracks, the lighting fixture comprising:

an elongated housing for a ballast and like electrical components, the housing comprising a substantially enclosed body having a lower surface and an upper surface;

a first holder for a fluorescent tube pivotably attached to the lower surface of the housing substantially adjacent to a first end of the housing;

a second holder for a fluorescent tube pivotably attached to the lower surface of the housing substantially adjacent to a second end of the housing;

cable means including a cable operatively connected with the ballast and fluorescent tubes in the holders and connectable with a standard electrical outlet for supplying power to fluorescent tubes in said holders;

an exterior channel member, having an upwardly directed open face, attached to the housing and disposed parallel to the elongated housing and running substantially along the entire length of the housing, said channel member being adapted to accommodate at least a portion of the cable; and fastening means for suspending the lighting fixture from the substantially horizontal disposed surface including a pair of spaced wire elements which pass through slots in the housing in a relatively movable manner and are adapted to having their ends engage support tracks along the horizontal surface, the ends of the tracks are relatively unrestrained to permit movement along the length of the support tracks.

8. The fixture of claim 7 wherein the fastening means is adapted to removably attach the fixture to said horizontally disposed surface without physically altering or changing said surface.

9. The fixture of claim 7 wherein the housing comprises a lower section and an upper section, the lower section having a generally U-shaped cross section and including an open face opposite a lower surface, the upper section being adapted to cover the open face and having a substantially downwardly protruding element to which the channel member is attached.

10. The fixture of claim 7 further comprising catch means attached to the housing for preventing full 360° rotation of each of the holders for the fluorescent tubes.

11. The fixture of claim 7 wherein the holders are adapted to pivot in both horizontal and vertical directions.

12. The fixture of claim 11 including mounting means for the holders comprising spring biased stirrup means adapted to pivotably mount an end of the associated holder through trunnion means at the end of the holder, said trunnion means being removably received in the stirrup means.

13. The fixture of claim 7 wherein the lighting means each include an enclosure for a fluorescent tube which, if the tube breaks while in the enclosure, retains substantially all the glass pieces of the broken tube, said enclosure comprising a translucent shade member having an open face and lens means covering the open face, said shade member and lens means being movable relative to each other to enable one to replace a broken or burned out fluorescent tube.

14. A lighting fixture primarily adapted for use in association with modular office furniture, and being adapted for removable attachment to the underside of a shelf and the like, the lighting fixture comprising:

an elongated housing for an electrical ballast, the housing including a lower section having a generally U-shaped cross-section which provides an upwardly directed open face and a lower base plate opposite the open face, and an upper section attached to the lower section to close the open face of the lower section, the upper section including a substantially vertically disposed plate attached to the base plate, the vertical plate protruding below the base plate of the lower section and, attached to the portion of the vertical plate protruding below the base plate of the lower section, a channel member running along a substantial part of the entire exterior length of the elongated housing;

a first fluorescent tube holder pivotably attached to the base plate of the lower section substantially adjacent to one end thereof;

a second fluorescent tube holder pivotably attached to the base plate of the lower section substantially adjacent to the other end thereof;

cable means, including a cable, operatively connecting fluorescent tubes in the holders to electrical power and adapted to supply electrical power from a standard electrical outlet to the fluorescent tubes, at least a portion of the cable being disposed in the channel member; and fastening means for removably fastening the lighting fixture to the underside of the shelf without physically altering or changing the shelf including a pair of spaced wire elements which pass through slots in the housing in a relatively movable manner and are adapted to having their ends engage tracks in the horizontal surface, the ends further capable of movement along the tracks.

15. The fixture of claim 14 wherein the first and second fluorescent tube holders each comprising a translucent shade member having a downwardly projecting open face and lens means for covering the open face.

16. The fixture of claim 14 wherein the holders are adapted to pivot in both horizontal and vertical directions.

17. The fixture of claim 16 including mounting means for the holders comprising spring biased stirrup means adapted to pivotably mount an end of the associated holder through trunnion means at the end of the holder, said trunnion means being removably received in the stirrup means.

18. A lighting fixture designed to be mounted to a shelf and like components in modular office furniture, wherein the shelf has a track therein including a pair of spaced, essentially parallel rail members, said lighting fixture comprising:

an elongated housing having slots therein and a lower surface;

means for removably fastening the housing to the shelf including elongated support elements which pass through the slots in the housing and have opposed ends engaging the rails to suspend the housing for operative relative movement along the elongated support elements relative to the shelf, the support elements further capable of relative movement along the rails; p1 a pair of lighting means each attached to the lower surface of the housing at opposed ends of the housing, said lighting means being mounted to pivot in both horizontal and vertical directions and including an enclosure for a fluorescent tube which, if the tube breaks while in the enclosure, retains substantially all the glass pieces of the broken tube;

catch means for preventing full 360° rotation of the lighting means; and cable means operatively connecting the lighting means to an electrical outlet.

19. The fixture of claim 18, wherein the elongated support elements are biased upward to frictionally engage the housing against the undeside of the shelf.

20. The fixture of claim 18 wherein the slots have a generally V-shape and the elongated support elements have at opposed ends pairs of fingers, one pair having adjacent ends joined together to form a V-type structure, the other pair having adjacent ends aligned in the form of a V-type structure but not joined together at said adjacent ends.

21. The fixture of claim 18 wherein the housing includes an upper section and a lower section, with the upper section being fastened to the shelf, said sections being made of metal, with insulating means between and electrically separating said sections and with the lower section connected to ground so that, if a short circuit occurs, current will not flow through the upper section into the modular office furniture.

22. The fixture of claim 21 wherein the upper section includes a vertical plate protruding below the lower section and having attached thereto a channel running along a substantial part of the entire length of the housing, said channel holding a portion of the cable means therein and said vertical plate serving as the catch means.

23. The fixture of claim 18 wherein the mounting means for the lighting means each includes spring biased stirrup means adapted to pivotably mount an end of the associated lighting means through trunnion means at the end of the lighting means, said trunnion means being removably received in the stirrup means.

24. The fixture of claim 18 wherein the lighting means each include a translucent shade member having an open face and lens means covering the open face.

25. A lighting fixture designed to be mounted to a shelf and like components in modular office furniture, comprising:

an elongated housing having an upper and a lower section made of metal, with the upper section being removably connected to the underside of the shelf and said sections having insulating means between them, with the lower section connected to ground so that, if a short circuit occurs, current will not flow through the upper section into the modular office furniture;

a pair of lighting means each attached to the underside of the lower section at opposed ends of this section by mounting means which allow the lighting means to pivot in both horizontal and vertical directions, each lighting means including a translucent shade member having an open face and lens means covering the open face, said mounting means including spring biased stirrup means adapted to pivotably mount an end of an associated lighting means through trunnion means at the end of the lighting means, said trunnion means being removably received in the stirrup means wherein the housing is removably attached to the shelf by fastening means including support elements which pass through slots in the housing and have their ends engaging tracks in the shelf for relative movement.

26. The fixture of claim 25 wherein the lighting means each include an enclosure for a fluroescent tube which, if the tube breaks while in the enclosure, retains substantially all the glass pieces of the broken tube, said enclosure comprising a translucent shade member having an open face and lens means covering the open face, said shade member and lens means movable relative to each other to enable one to replace a broken or burned out fluorescent tube.

27. In combination with a modular office furniture panel system haviing a horizontal support surface over a work station, the improvement being a lighting fixture comprising:

a housing member;

at least one lighting member pivotally attached to the housing member and relatively movable for adjusting the distribution of light, and movable support means connected to the housing member and the horizontal support surface for defining a range of movement of the housing member beneath the horizontal support surface so that the housing member can be translated relative to the work station in at least a first direction and a second direction perpendicular to the first direction while the lighting member can be independently positioned beneath or pivoted from the housing member to subjectively vary the light distribution.

28. The invention of claim 27 wherein the lighting member is pivotally connected with the housing member to rotate in both vertical and horizontal planes.

29. The invention of claim 27 wherein the housing member is frictionally biased against the underside of the support surface.

30. The invention of claim 27 wherein the support means includes a pair of elongated arms that are movable relative to one another from a biased offset neutral position.

31. The invention of claim 27 wherein the housing member is split into an upper and lower housing section that are connected together by electrically insulated connectors.

32. The invention of claim 28 wherein the support means is further capable of transverse movement relative to the movement of the housing member along the support means.

33. The invention of claim 29 further including low friction means provided on the upper surface of the housing member to facilitate movement.

34. The invention of claim 30 wherein the elongated arms are integrally connected at one end and are split at the other end.

35. In combination with a modular office furniture panel system having a horizontal support surface with parallel tracks over a work station, the improvement being a removable lighting fixture that can be adjustably positioned over the work station comprising:

a housing member;

at least one elongated lighting member pivotally attached at one end to the housing member and relatively movable in horizontal and vertical planes for adjusting the distribution of light;

means for electrically connecting the lighting member to a source of power;

means for insulating the lighting member from electrical conduction to the panel system, and removable support means connected to the housing member and the horizontal support surface parallel tracks for defining a range of movement of the housing member beneath the horizontal support surface so that the housing member can be translated relative to the work station in at least a first direction and a second direction perpendicular to the first direction while the lighting member can be independently positioned beneath or pivoted away from the housing member to subjectively vary the light distribution.

* * * * *